United States Patent [19]

Hans

[11] Patent Number: 4,982,519

[45] Date of Patent: Jan. 8, 1991

[54] IDENTIFICATION DEVICE FOR FUEL INJECTION VALVES

[75] Inventor: Waldemar Hans, Bamberg, Fed. Rep. of Germany

[73] Assignee: Robert Bosch GmbH, Stuttgart, Fed. Rep. of Germany

[21] Appl. No.: 299,510

[22] Filed: Jan. 23, 1989

[30] Foreign Application Priority Data

Feb. 12, 1988 [DE] Fed. Rep. of Germany ... 8801817[U]

[51] Int. Cl.[5] ..... G09F 3/16

[52] U.S. Cl. ..... 40/666

[58] Field of Search ..... 40/299, 666, 663, 316, 40/639, 641, 640, 662; 63/29.1; 24/113 MP, 581, 580, 587; 251/369

[56] References Cited

U.S. PATENT DOCUMENTS

| | | | |
|---|---|---|---|
| 1,763,024 | 6/1930 | Underhill et al. | 40/666 |
| 2,600,825 | 6/1952 | Aigner | 40/666 X |
| 2,910,985 | 11/1959 | Epstein et al. | 40/641 X |
| 4,829,641 | 5/1989 | Williams | 24/487 |

FOREIGN PATENT DOCUMENTS 3540660 5/1987 Fed. Rep. of Germany .

*Primary Examiner*—James R. Brittain

*Attorney, Agent, or Firm*—Edwin E. Greigg

[57] ABSTRACT

An identification device for a fuel injection valve in which the device is made in a U-shaped body of plastic which may be of any desired color. The device includes oppositely disposed snap-in protrusions on the legs of the U-shaped body which fit into matching dents in a coating on the fuel injection valve. The coating is formed such that a portion extends beyond the ends of the legs of the identification device to prevent easy removal of the identification device.

20 Claims, 1 Drawing Sheet

IDENTIFICATION DEVICE FOR FUEL INJECTION VALVES

BACKGROUND OF THE INVENTION

The invention relates to an identification device for fuel injection valves as defined hereinafter. In a known fuel injection valve, (German Offenlegungsschrift No. 35 40 660) to identify valve-specific rating data, the color of the plastic extrusion coating of the fuel injection valve, which receives the electrical plug, is varied, and the plastic extrusion coating is provided with both a code, made up of letters and numbers, and a company logo. This has the disadvantage that because the plastic extrusion coating is made from various colored materials, its dimensions undesirably vary once the plastic extrusion composition has cooled to compensate for these deviations, different injection tools must be used for the different colored plastic extrusion coatings. Furthermore, the injection tool must also be designed for placement of the proper code for the fuel injection valve on the plastic extrusion coating.

OBJECT AND SUMMARY OF THE INVENTION

The identification device for fuel injection valves as defined hereinafter has the advantage over the prior art that different types of fuel injection valves can easily be provided with a plastic extrusion coating with constant manufacturing tolerances and without changing the coloring; the identification of any fuel injection valve is accomplished simply in that the identification devices, carrying the required type designations, codes and company logos, are attached to the individual fuel injection valves and joined to them by means of a snap-in connection. As a result, substantially simpler plastic injection tools can be used for producing the plastic sheaths on the fuel injection valves.

Further advantages of the identification device will become apparent to those skilled in this art. One such advantage is that the identification device is made of plastic, in particular colored plastic. Another advantage is that each leg of the identification device has at least one snap-in protrusion that engages a detent edge of the fuel injection valve from behind.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 2:
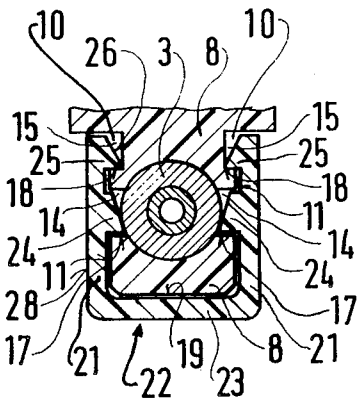
FIG. 2 is a section taken along the line II—II of FIG. 1.
Figure 1:
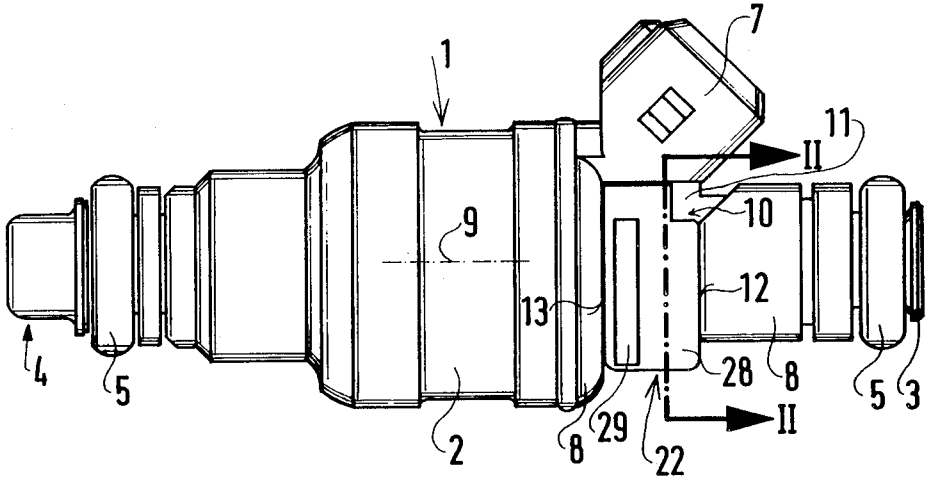
FIG. 1 shows a fuel injection valve having an identification device.

The fuel injection valve 1, shown in FIGS. 1 and 2, for a fuel injection system of a mixture-compressing internal combustion engine having externally supplied ignition is known for instance from German Offenlegungsschrift No. 35 40 660 and has a valve housing 2 of ferromagnetic material. A fuel inlet fitting 3 is joined to the valve housing by flanging; by way of this fitting, fuel, such as gasoline, can flow under pressure into the fuel injection valve. In the open state of the fuel injection valve, fuel is injected via an injection end 4 of the fuel injection valve which is remote from the fuel inflow fitting 3. Elastic sealing rings 5 on the fuel inflow fitting 3 and on the injection end 4 provide sealed noiseless support of the fuel injection valve.

An electrical plug connection 7, which carries current to the electromagnetically actuatable fuel injection valve, is part of a plastic extrusion coating 8, which in sheath-like fashion surrounds both the flanged connection between the fuel inflow fitting 3 and the valve housing 2 and the fuel inflow fitting 3 itself. Transversely to the longitudinal axis 9 of the fuel injection valve 1, the plastic extrusion coating 8 has two receiving grooves 10 extending symmetrically to the longitudinal axis 9; each receiving groove has a preferably flat bottom face 11, a side face 12 oriented toward the fuel inflow fitting 3, and a side face 13 oriented toward the injection end 4. The side faces 12, 13 extend approximately transversely to the longitudinal axis 9. Extending parallel to the longitudinal axis 9, each bottom face 11 has a first detent groove 14 and a second detent groove 15, spaced apart from the first detent groove, machined in indented fashion into it. One lateral boundary of each first detent groove 14 forms a first detent face 17, which terminates at the bottom face 11 and extends approximately parallel to the longitudinal axis 9. Each second detent groove 15 is bounded on one side by a second detent face 18, which terminates at the bottom face 11 and extends approximately parallel to the longitudinal axis 9. Approximately facing the plug connection 7, the plastic extrusion coating 8 has a flat connecting face 19 joining the two bottom faces 11 and extending approximately parallel to the longitudinal axis 9, so that except for the vicinity of the plug connection 7, a rectangular cross section transverse to the longitudinal axis 9 is produced in the vicinity of the plastic extrusion coating 8 having the receiving grooves 10.

According to the invention, an identification device 22 is disposed transversely to the longitudinal axis and has legs 21 thrust into the receiving grooves 10. The identification device 22 is in the form of a U, with its legs 21 extending spaced apart and joined by a bottom 23. Thus, each of the legs 21 extend approximately parallel to the bottom face 11, while the bottom 23 extends approximately parallel to the connecting face 19. The height of the identification device 22 in the direction of the longitudinal axis 9 is approximately equivalent to the height of each receiving groove 10 between the side faces 12, 13, in the direction of the longitudinal axis 9. Protruding from each leg 21, oriented toward each bottom face 11 of each receiving groove 10, is a first snap-in protrusion 24 and spaced apart from it in the direction away from the bottom 23 a second snap-in protrusion 25. When the identification device 22 is inserted into the receiving grooves 10 in the direction toward the plug connection 7, the first snap-in protrusions 24 engage the first detent grooves 14 and in succession the second snap-in protrusions 26 engage the second detent grooves 15, preventing the identification device 22 from being pulled back out again. In this condition, the first snap-in protrusions 25 come to rest on the first detent faces 17, and the second snap-in protrusions 25 come to rest on the second detent faces 18. The snap-in protrusions 24, 25 are approximately sawtooth-like in shape, with their points resting on the detent faces 17, 18, and they have thrust faces 26, which are inclined toward the legs 21 and their free ends, to make it easier to slip the identification device 22 onto the plastic extrusion coating 8. The side faces 12 of the receiving grooves 10 are embodied as wide enough in the radial direction that they protrude beyond the legs 21; this prevents a tool from undesirably spreading the legs 21 apart in order to remove the identification device 22 from the fuel injection valve 1. The intention is that the identification device can be removed only by considerable force, which will destroy the device 22.

Advantageously, the identification device 22 is made of a plastic that assures that when the device is slipped onto the plastic extrusion coating 8, the legs 21 can be spread elastically apart far enough that the snap-in protrusions 24, 25 can snap into the detent grooves 14, 15 and lock in place. For identifying the various types of fuel injection valve, it may be advantageous to vary the color of the identification device, or in other words of the plastic used. Codes 29, in the form of letters and numbers, and company logos can be provided on at least one of the outer faces 28 in the course of manufacture of the identification device 22.

The invention allows dimensionally accurate manufacture of a fuel injection valve 1 with a plastic extrusion coating 8 of uniform color and allows the subsequent identification of the valve, in terms of its type and its rating data, by slipping the easily manufactured identification device 22 onto it.

The foregoing relates to a preferred exemplary embodiment of the invention, it being understood that other variants and embodiments thereof are possible within the spirit and scope of the invention, the latter being defined by the appended claims.

I claim:

1. An identification device for use in combination with a fuel injection valve, said identification device (22) is U-shaped in embodiment and has two oppositely disposed legs (21) originating at a bottom (23) and spaced apart from one another, each of said legs include an inner surface, face, at lest one of said legs is provided with at least a first snap-in means on a portion of said inner surface face thereof, said fuel injection valve includes at least one second snap-in means, and said identification device encompasses a portion of said fuel injection valve (1) including said at least one second snap-in means and is joined to said injection valve via said at least one second snap-in means (14, 15, 17, 18) formed on a portion of said fuel injection valve (1) in which said at least first snap-in means interfits, said first snap-in means and said second snap-in means are embodied as a protrusion and/or indentation.

2. An identification device as defined by claim 1, in which said identification device (22) is disposed transversely to a longitudinal axis (9) of the fuel injection valve (1).

3. An identification device as defined by claim 2, in which said identification device (22) is made of plastic.

4. An identification device as defined by claim 2, in which said identification device (22) is made of colored plastic.

5. An identification device as defined by claim 1, in which said identification device (22) is made of plastic.

6. An identification device as defined by claim 5, in which said identification device (22) has opposing outer faces (28) on which information is designated.

7. An identification device as defined by claim 5, in which each leg (21) has at least one snap-in protrusion (24, 25), which grips detent faces (17, 18) of the fuel injection valve (1) from behind.

8. An identification device as defined by claim 7, in which each leg (21) has at least two snap-in protrusions on their inner surface whereby said at least two snap-in protrusions grip oppositely disposed matching detent faces on said fuel injection valve.

9. An identification device as defined by claim 1, in which said identification device (22) is made of colored plastic.

10. An identification device as defined by claim 9, in which said identification device (22) has opposing outer faces (28) on which information is designated.

11. An identification device as defined by claim 9, in which each leg (21) has at least one snap-in protrusion (24, 25), which grips detent faces (17, 18) of the fuel injection valve (1) from behind.

12. An identification device as defined by claim 11, in which each leg (21) has at least two snap-in protrusions on their inner surfaces whereby said at least two snap-in protrusions grip oppositely disposed matching detent faces on said fuel injection valve.

13. An identification device as defined by claim 1, in which said identification device (22) has opposing outer faces (28) on which information is designated.

14. An identification device as defined by claim 1, in which each leg (21) has at least one snap-in protrusion (24, 25), which grips detent faces (17, 18) of the fuel injection valve (1) from behind.

15. An identification device as defined by claim 14, in which each leg (21)has at least two snap-in protrusions on their inner surface whereby said at least two snap-in protrusions grip oppositely disposed matching detent faces on said fuel injection valve.

16. A combination identification device and fuel injection valve in which said identification device (22) is U-shaped in embodiment and has two oppositely disposed legs (21) originating at a bottom (23) and spaced apart from one another, each of said legs include an outer surface face and an inner surface face, at least one of said legs is provided with at least one first snap-in means on a portion of said inner surface face, a portion of said injection valve includes at least one second snap-in identation means on an outer surface portion thereof, said identification device is adapted to encompass said outer surface portion of said fuel injection valve (1) and be joined to said outer surface portion of said fuel injection valve by said at least one first snap-in means on said inner surface face interfitting said at least one second snap-in means on said outer surface of said fuel injection valve, said first snap-in means and said second snap-in means are embodied as a protrusion and/or indentation.

17. A combination identification device and fuel injection valve as defined by claim 16, in which said identification device (22) is disposed transversely to a longitudinal axis (9) of the fuel injection valve (1).

18. A combination identification device and fuel injection valve as defined by claim 16, in which said outer surface faces of said identification device (22) have attaching designations (29) thereon.

19. A combination identification device and fuel injection valve as defined by claim 16, in which each leg (21) of said identification device includes at least one snap-in protrusion (24,25), which grips detent faces (17, 18) on said outer surface portion of the fuel injection valve (1) from behind.

20. A combination identification device and fuel injection valve as defined by claim 16, in which each leg (21) of said identification device includes at least two snap-in protrusions which grip oppositely disposed matching detent faces on said outer surface portion of said fuel injection valve.

* * * * *